United States Patent [19]

Coles, III

[11] Patent Number: 4,531,891

[45] Date of Patent: Jul. 30, 1985

[54] FLUID BYPASS CONTROL FOR PRODUCING WELL PLUNGER ASSEMBLY

[76] Inventor: Otis C. Coles, III, P.O. Box 5197, Abilene, Tex. 79608

[21] Appl. No.: 570,609

[22] Filed: Jan. 11, 1984

[51] Int. Cl.[3] ..... F04B 47/12

[52] U.S. Cl. ..... 417/59; 92/193; 92/247

[58] Field of Search ..... 417/56-60; 92/193, 200, 247

[56] References Cited

U.S. PATENT DOCUMENTS 2,267,902 12/1941 Eddins ..... 417/60

3,055,306 9/1962 Tausch ..... 417/60

3,249,056 5/1966 Lyles ..... 417/59

4,239,458 12/1980 Yeatts ..... 417/60

*Primary Examiner*—Edward K. Look

*Attorney, Agent, or Firm*—Harvey B. Jacobson

[57] ABSTRACT

The mandrel of a fluid lift plunger carries pads retracted from a tube string by the continuous bias of collapsing springs. A control rod is displaceable relative to the mandrel causing a change in the force of detent springs which exert a continuous radially outward bias on the pads. In the detent held position assumed by the control rod during upward plunger travel, a higher detent spring force is exerted on the pads to overcome the collapsing springs and hold the pads in wiping contact with the tube string.

13 Claims, 8 Drawing Figures

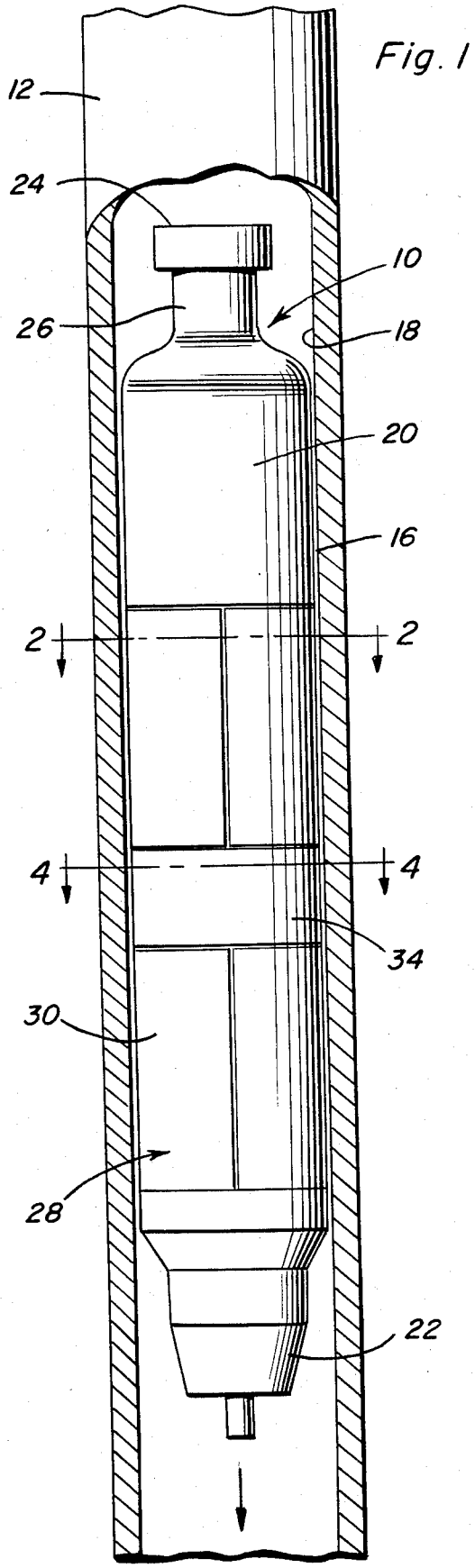
Fig. 1
Fig. 2
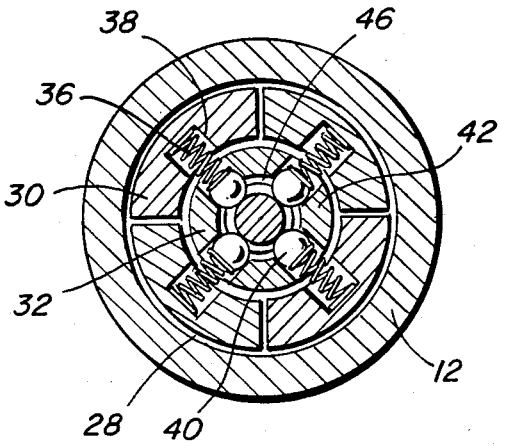
Fig. 4
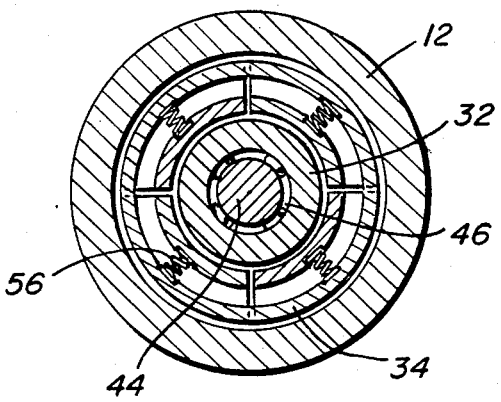
Fig. 4a
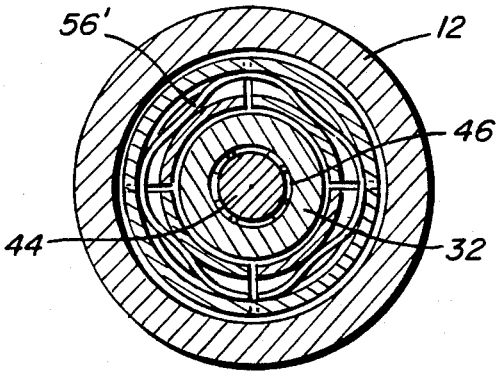

FLUID BYPASS CONTROL FOR PRODUCING WELL PLUNGER ASSEMBLY

BACKGROUND OF THE INVENTION

This invention relates to a free piston type of plunger assembly commonly utilized for fluid lift purposes in wells from which fluids are extracted including but not necessarily limited to oil and natural gas such as $CO_2$, etc.

Generally, the foregoing type of fluid lift plunger assembly is provided with pads establishing wiping contact with the internal wall surface of an enclosing tube string during reciprocation of the plunger assembly. During descent of the plunger assembly, the pads are retracted by positive mechanical linkages from the tube string walls for bypass flow of fluids according to U.S. Pat. No. 3,273,504 to Lyles. Bypass flow is conducted through internal passages in the mandrel body of the plunger assembly under valve control according to U.S. Pat. Nos. 3,424,093, 4,239,458 and 4,030,818 to Moore, Yeats and Coles, respectively, so that the pads remain in wiping contact with the tube string at all times.

In the case of a plunger assembly having linkage retracted pads, sand, grains and other substances from a fractured formation within which the tube string is installed often become wedged and trapped between moving parts of the retracting linkage mechanism to adversely affect performance. Further, the provision of such retracting mechanism makes manufacture of the plunger assembly costly while repair, parts replacement and maintenance sometimes becomes economically prohibitive. In the case of plunger assemblies through which internal bypass flow passages are established by valve control, other problems arise because of pad contact during descent, including tube string wear, deterioration of pad sealing and valve malfunction.

It is therefore an important object of the present invention to provide a plunger assembly that is inherently less costly to fabricate, repair and maintain despite the reliance on pads retracted during descent in order to establish a bypass flow passage, thereby avoiding the problems associated with valve controlled internal bypass flow types of plunger assemblies.

An aditional object in accordance with the foregoing object is to provide a fluid lift type plunger assembly utilizing pads that are retracted during descent without use of any complex linkage mechanism.

SUMMARY OF THE INVENTION

In accordance with the present invention, the wall contacting pads of the plunger assembly are retracted under a continuous bias of pad collapsing springs. The bias of the collapsing springs is overcome only during descent of the plunger assembly by automatic impact responsive displacement of a control rod slidably mounted within the mandrel body of the plunger assembly carryiing the pads. Detents yieldably hold the control rod in two operative positions. The detents include ball elements aligned with grooves in the control rod of different axial dimension to thereby change the force of springs biasing the detent balls. The detent engaging springs also exert a continuous radially outward bias on the pads so that only in the operative position assumed by the control rod during upward travel of the plunger assembly will the bias of the pad collapsing springs be automatically overcome to disable the collapsing means and permit expansion of the pads by the detent springs into wiping contact with the tube string.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

FIG. 1 is a side elevation view of a fluid lift plunger assembly in accordance with the present invention within a vertical tube string partially shown in section to expose the plunger assembly during descent.

FIG. 2 is a transverse section view taken substantially through a plane indicated by section line 2—2 in FIG. 1.

FIG. 4 is a transverse section view taken substantially though a plane indicated by section line 4—4 in FIG. 1.

FIG. 4*a* is a transverse section view similar to FIG. 4, but showing a modification.

Figure 3:
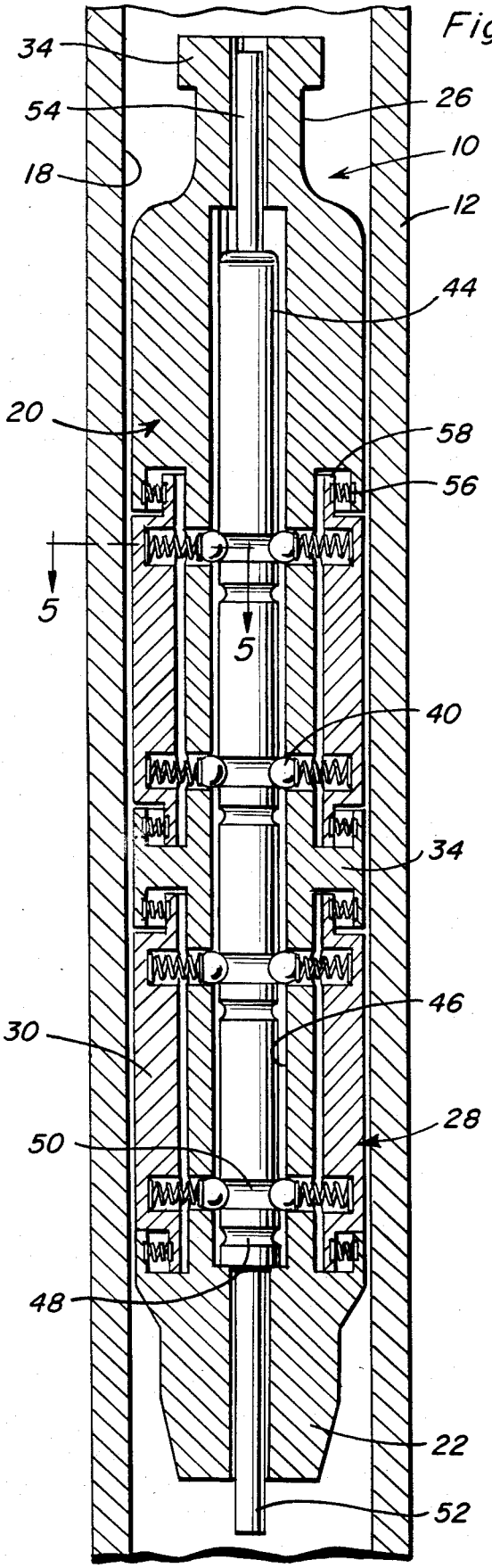
FIG. 3 is an enlarged longitudinal section view taken substantially through a plane indicated by section line 3—3 in FIG. 2.
Figure 5:
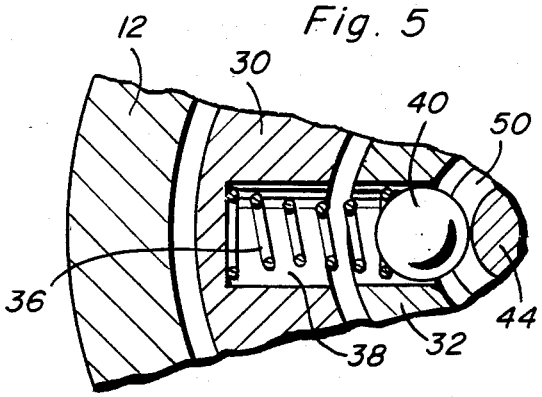

FIG. 5 is an enlarged partial section view taken substantially through a plane indicated by section line 5—5 in FIG. 3.

Figure 6:
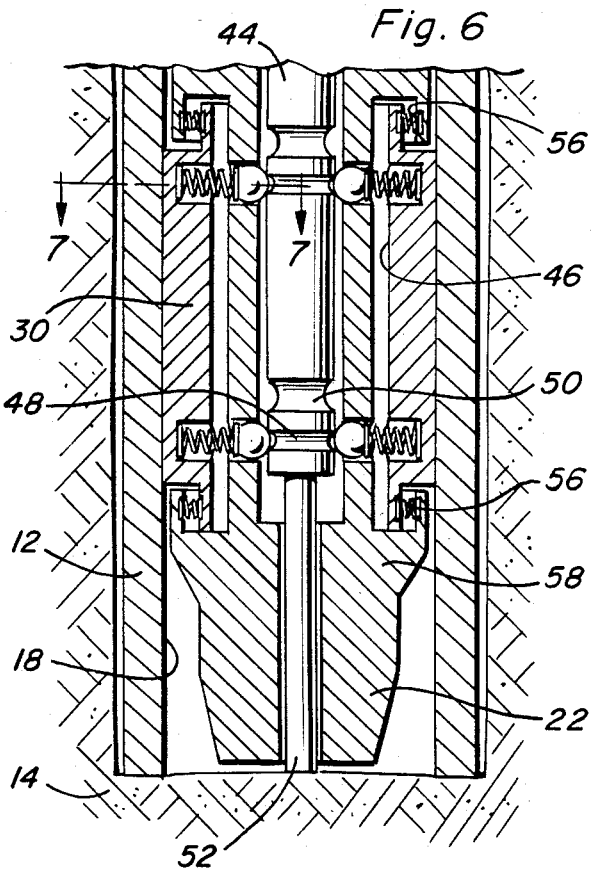

FIG. 6 is a partial longitudinal section view similar to that of FIG. 3 showing the tube string and the plunger assembly at a bottom hole position within a well formation.

Figure 7:
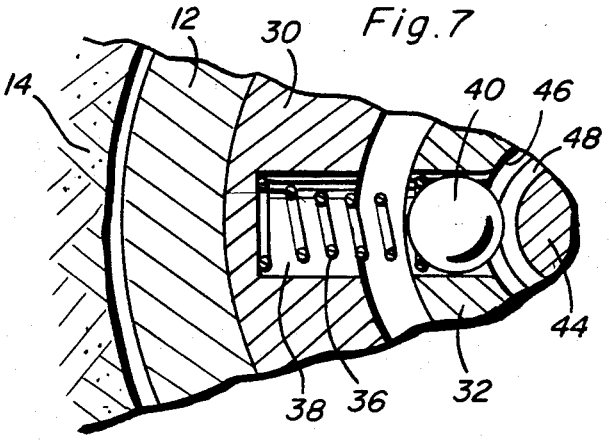

FIG. 7 is an enlarged partial section view taken substantially through a plane indicated by section line 7—7 in FIG. 6.

DETAILED DESCRIPTION OF PREFERRED EMBODIMENTS

Referring now to the drawings in detail, FIGS. 1 and 3 illustrate a fluid lift plunger assembly generally referred to by reference numeral 10 shown during descent within a tube string 12. FIG. 6 shows the plunger assembly descended to a bottom hole position in a well formation 14 within which the tube string 12 is adapted to be installed. After reaching such bottom hole position, the plunger assembly is drawn upwardly within the tube string to lift fluid to the surface as the plunger assembly approaches an upper limit position (not shown). In accordance with the present invention, during descent the plunger assembly is in a dimensionally contracted condition to form an annular bypass flow space thereabout within the tube string in order to enable descent without frictional resistance from contact with the internal wall surface 18 of the tube string. During upward travel the plunger assembly is in a dimensionally expanded conditions as shown in FIG. 6 in order to establish wiping contact with the internal wall surface of the tube string for fluid lift purposes.

As more clearly seen in FIG. 3 the plunger assembly includes an elongated body frame or mandrel 20 having an outer diameter somewhat less than the internal diameter of the tube string. The mandrel has a lower tapered nose portion 22 and a fishing enlargement 24 at its upper end axially spaced by neck portion 26 from the diametrically enlarged portion of the mandrel. By way of example, the mandrel supports two pad assemblies 28 through which wiping contact with the tube string wall surface 18 is established as shown in FIGS. 6 and 7. Each pad assembly includes by way of example only four arcuate pad elements 30 mounted in surrounding relation to a small diameter core portion 32 of the mandrel as more clearly seen in FIG. 2. The core portion 32 of the mandrel interconnects the upper end and lower nose portions as shown in FIG. 3 and has a flange portion 34 extending radially outward therefrom to the outer diameter. The flange portion 34 is located longitudinally between the two pad assemblies intermediate the upper and lower ends of the mandrel as shown in FIGS. 1 and 3. Flange portions are also provided at the upper and lower ends of the mandrel at the outer diameter as shown.

The pad elements 30 are biased radially outward into wiping contact with the tube string by coil springs 36 seated within recesses 38 formed in each pad element as more clearly seen in FIG. 2. In accordance with the present invention, the coil springs 38 react against detent ball elements 40 caged within radial bores 42 formed in the core portion 32 of the mandrel. The detent elements 40 serve the dual function of (a) changing the magnitude of the radially outward force of the springs 36 on the pad elements 30 and (b) yieldably holding an elongated control rod 44 in one of two operative positions within the mandrel. The control rod 44 is slidably displaceable within a central bore 46 extending through the mandrel. In the illustrated embodiment, there are two sets of axially spaced detent balls and springs 36 associated with each pad element exerting equal radially outward force on the pad elements to maintain uniform wiping contact throughout. Each set of four detent ball elements 40 is adapted to be received in one of two, closely spaced detent grooves 48 and 50 formed in the control rod. The detent grooves 48 are smaller in axial dimension than the detent grooves 50 as shown in FIGS. 3 and 6. In one of the operative axial positions of the control rod, each detent ball 40 is seated in a groove 50 as shown in FIGS. 3 and 5 so as to predetermine a lower spring force for its associated spring 36. In the other operative position of the control rod 44 as shown in FIGS. 6 and 7, the detent balls 40 engage the control rod at the smaller grooves 48 so as to assume radial positions spaced outwardly somewhat from the positions occupied when seated in grooves 50. Accordingly, the springs 36 are compressed to a somewhat grater extent by the detent balls when aligned with grooves 48 to predetermine a higher radially outward spring force exerted on the pad elements. It will therefore be apparent that the control rod when displaced between its two operative positions will change the magnitude of the radially outward force exerted on the pad elements.

The control rod 44 is displaced between its two operative positions by means of actuating end portions 52 and 54 alternatively projecting from the lower and upper ends of the mandrel. Thus, when the control rod is in the lower operative position as shown in FIG. 3, the lower end portion 52 projects from the lower nose portion 22 of the mandrel during descent of the plunger assembly. As the plunger assembly approaches the bottom hole position as shown in FIG. 6, the actuating end portion 52 of the control rod impacts to upwardly displace the control rod to its upper operative position relative to the mandrel in which the detent elements 40 are aligned with the smaller grooves 48 to increase the radially outward forces exerted by springs 36 on the pad elements 30. The pad assemblies 28 are thereby maintained in expanded condition during subsequent upward travel of the plunger assembly with the actuating end portion 54 of the control rod projecting from the upper end. When the plunger assembly reaches the upper limit of travel (not shown), the end portion 54 is also actuated by impact to displace the control rod downwardly to the operative position in which the detent balls 40 are aligned with grooves 50 to maintain the pad assemblies 28 in contracted condition subsequent during descent of the plunger assembly.

The pad assemblies are contracted against the radially outward bias of springs 36 by pad collapsing means in the form of coil springs 56 engaging smaller diameter, axial end sections 58 of the pad elements 30 in axial alignment with radially spaced socket portions 60 and 62 of the lower nose portion 22 and upper end portion, respectively, of the mandrel 20, and with the flange 34. Accordingly, a set of four pad collapsing coil springs 56 at each axial end of the pad assemblies 28 are provided, as more clearly seen in FIG. 2. The coil springs 56 are designed to exert a continuous radially inward bias on the pad elements 30 of a magnitude greater than the outward bias of springs 36 in the operative position of control rod 44 shown in FIGS. 3 and 5, but less than the outward bias in the other operative position shown in FIGS. 6 and 7. Accordingly, the pad collapsing means will be disabled only during upward travel of the plunger assembly when the higher outward bias of springs 36 is established by the control rod in its upper operative position. It is the higher bias force exerted by springs 36 that resists and overcomes the radially inner bias force of the pad collapsing springs 56 which are therefore effective only during descent of the plunger assembly to maintain the pad assemblies in the contracted condition.

FIG. 4*a* illustrates another embodiment or modification wherein each set of four pad collapsing coil springs 56 as shown in FIG. 4, are replaced by a single annular leaf spring 56' having circumferentially spaced portions alternately contacting the mandrel and the pad elements. The springs 56' perform the same pad collapsing function as coil springs 56 in exerting a radially inward bias on the pad elments overcome or disabled by the radially outward bias of springs 36 only in the operative position of the control rod 44 maintained by detents 40 during upward travel of the plunger assembly.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a plunger assembly adapted to be reciprocated within a tube string for lifting fluid during upward travel from a bottom hole position to which the plunger assembly descends, the plunger assembly having an elongated mandrel, pad means mounted on the mandrel for radial displacement relative thereto, and spring means for biasing the pad means radially outward into wiping contact with the tube string, the improvement comprising collapsing means continuously biasing the pad means radially inward against the bias of the spring means to establish a fluid bypass space about the plunger assembly within the tube string, and means for automatically rendering the collapsing means ineffective to establish the fluid bypass space only during said upward travel of the plunger assembly from the bottom hole position.

2. The improvement as defined in claim 1 wherein the disabling means includes an elongated rod slidably mounted in the mandrel having an impact end portion, detent means for yieldably holding the rod in two operative positions wherein said end portion is respectively retracted within and projecting from the mandrel, and means rendered operative in one of the operative positions of the rod for resisting the radially inward bias exerted on the pad means by the collapsing means.

3. The improvement as defined in claim 2 wherein the detent means includes at least two grooves formed in the rod and a detent element carried by the mandrel and biased by the spring means into engagement with said grooves of the rod in the two operative positions thereof.

4. The improvement as defined in claim 3 wherein said bias resisting means comprises means seating the spring means in the pad means for engagement with the detent element, one of the two grooves in the rod being smaller in axial dimension and engageable with the detent element in said one of the operative positions of the rod.

5. The plunger assembly as defined in claim 4 wherein said collapsing means includes a plurality of circumferentially spaced coil springs exerting a radially inward bias on the pad means less than the radially outward bias exerted by the spring means in said one of the operative positions of the rod.

6. The plunger assembly as defined in claim 4 wherein said collapsing means includes a leaf spring exerting radially inward bias on the pad means less than the radially outward bias exerted by the spring means in said one of the operative positions of the rod.

7. In a plunger assembly adpated to be reciprocated within a tube string for lifting fluid during upward travel from a bottom hole position to which the plunger assembly descends, the plunger assembly having an elongated mandrel, pad means mounted on the mandrel for radial displacement relative thereto, and spring means for biasing the pad means radially outward into wiping contact with the tube string, the improvement comprising collapsing means continuously biasing the pad means radially inward against the bias of the spring means to establish a fluid bypass space about the plunger assembly within the tube string, control means mounted within the mandrel for displacement relative thereto, and means responsive to said displacement of the control means for rendering the collapsing means ineffective to thereby enable the spring means to hold the pad means in wiping contact with the tube string only during the upward travel.

8. The improvement as defined in claim 7 wherein said disabling means includes means mounting the spring means for changing the radially outward bias exerted in response to said displacement of the control means.

9. The improvement as defined in claim 8 including detent means engageable by the spring means for yieldably holding the control means in two operative positions between which the control means is displaced.

10. The improvement as defined in claim 9 wherein said control means includes an elongated rod having at least two axially spaced grooves of different dimension within which the detent means is received, and an actuating end portion projecting from the mandrel.

11. In a plunger assembly adapted to be reciprocated within a tube string for lifting fluid during upward travel from a bottom hole position to which the plunger assembly descends, the plunger assembly having an elonated mandrel, pad means mounted on the mandrel for radial displacement relative thereto, spring means for exerting a radially outward force biasing the pad means into wiping contact with the tube string, a control rod slidably mounted in the mandrel having an actuating end portion projecting from the mandrel, and detent means for yieldably holding the control rod in two operative positions, the improvement comprising means for changing said radially outward force of the spring means in response to displacement of the control rod between said two operative positions thereof, and collapsing means for continuously exerting a radially inward force on the pad means of a magnitude greater than the radially outward force of the spring means in only one of the two operative positions of the control rod, whereby the pad means is retracted from the tube string during the descent of the plunger assembly.

12. The improvement as defined in claim 11 wherein said force changing means includes axially spaced detent grooves on the control rod of different axial dimension and means mounting the detent means in the mandrel for engagement with the detent grooves under the bias of the spring means.

13. An oil well providing an external bypass of fluid therepast for operation of a well tubing, comprising a frame with a longitudinally extending recess 29 therethrough, a rod slidably held in said recess in two positions, at least two series of sealing elements, each of such series circumscribing the periphery of said frame, a spring nested in each of the elements of at least one of said series, said spring pressing each of said elements outward to block the external bypass, the elements of one series not being contiguous with spaces between elements of the other series and said series being adjacent each other, said rod having portions of different dimension along the length thereof, and rod holding means for yieldably retaining the rod in said two positions thereof under urging of said springs including locking elements between said rod and said frame, said springs urging said locking elements into contact with said portions of the rod of different dimensions rendering the springs ineffective to block the external bypass in only one of the two positions of the rod.

* * * * *